United States Patent [19]

Kretchmar et al.

[11] Patent Number: 4,787,857

[45] Date of Patent: Nov. 29, 1988

[54] RECTIFIER HOUSING FOR USE BETWEEN A LINE CORD AND A WALL OUTLET

[76] Inventors: William J. Kretchmar, 6900 NW. 4th Ave., Boca Raton, Fla. 33431; Dale N. Strickland, 9483 Burlington Pl., Boca Raton, Fla. 33434

[21] Appl. No.: 892,912

[22] Filed: Aug. 1, 1986

[51] Int. Cl.[4] ..... H01R 29/00

[52] U.S. Cl. ..... 439/189; 439/651; 439/620

[58] Field of Search ..... 339/75 R, 75 P, 153, 339/154, 156, 157 R, 157 C, 159 R, 159 C, 166 R, 166 T, 167, 168, 170, 147 R, 147 P, 125 R, 31, 32; 315/220 R, 272; 313/111, 113; 200/51.14, 298; 439/620, 189

[56] References Cited

U.S. PATENT DOCUMENTS

| | | | |
|---|---|---|---|
| 1,752,225 | 3/1930 | Birchall | 339/157 R |
| 2,186,184 | 1/1940 | Tubbs | 339/170 |
| 2,759,160 | 8/1956 | Kelley | 339/75 P |
| 3,005,179 | 10/1961 | Holt | 339/159 C |
| 3,372,302 | 3/1968 | Fasola | 315/200 R |
| 3,836,814 | 9/1974 | Rodriquez | 315/200 R |
| 4,202,588 | 5/1980 | Dalamangus et al. | 339/125 R |
| 4,229,680 | 10/1980 | Berlin, Jr. et al. | 315/200 R |
| 4,500,160 | 2/1985 | Bertsch | 339/166 R |

*Primary Examiner*—David Pirlot

*Attorney, Agent, or Firm*—Fleit, Jacobson, Cohn & Price

[57] ABSTRACT

A rectifier housing including a plug end and a receptacle end for interconnecting a line cord from a single incandescent light bulb as well as from a plurality of incandescent light bulbs with an electric wall outlet or with the receptacle end of an extension cord. A rectifier element in the form of a diode is positioned within the housing and is in electrical contact with one of the blades of the plug and one of the blade-receiving slots of the receptacle to provide rectified power to a single filament electric lamp, a multiple filament electric lamp, or a plurality of single filament electric lamps. The housing can be provided with a plurality of receptacles, one or more of which can be connected through a rectifier to provide rectified power from respective ones of the receptacles.

5 Claims, 4 Drawing Sheets

RECTIFIER HOUSING FOR USE BETWEEN A LINE CORD AND A WALL OUTLET

BACKGROUND OF THE INVENTION

Field of the Invention

This invention relates to rectifier housings for use with incandescent electric light bulbs, and more particularly to a rectifier housing that can be inserted into an electric wall outlet and can receive a line cord plug that is connected with one or more lamp sockets.

The use of rectifier devices to extend the life of incandescent electric light bulbs is well in known. In such devices a half-wave rectifier is inserted in the light bulb socket, between the socket center terminal and the tip contact of the typical threaded-base-type light bulb, in order to extend the life of the bulb by reducing the effective voltage applied to the bulb filament. The rectifier operates essentially to convert alternating current to pulsating direct current, the effective voltage level of which is lower than that of the alternating current source. By imposing a lower effective voltage upon the light bulb filament, the operating life of the filament is substantially extended, in some instances enabling a bulb to operate for a period of 24 hours a day, seven days a week, for at least ten years.

In order to take advantage of the long light bulb life that results from the use of rectifier devices, various structures have been proposed in which a rectifier is provided in an electric line and in series with a light bulb filament. For example, a rectifier has been provided directly in a lamp socket as disclosed in U.S. Pat. No. 2,896,125, which issued July 21, 1959, to R. C. Morton. Diodes have also been incorporated in a double wall switch as also disclosed in the previously-identified Morton patent, as well as in a single, three position wall switch as disclosed in U.S. Pat. No. 3,309,554, which issued Mar. 14, 1967, to G. R. Lawson. Further, a diode has been provided as a part of a removable lamp socket that includes an on-off switch, as disclosed in U.S. Pat. No. 3,517,259, which issued June 23, 1970, to G. A. Dotto, and in a removable lamp socket that includes a bright-dim switch as disclosed in U.S. Pat. No. 3,372,302, which issued Mar. 5, 1968, to H. Fasola.

In addition to placement in wall switches and in light bulb sockets, rectifiers have also been positioned in line cords themselves together with a line cord miniature switch, as disclosed in U.S. Pat. No. 4,166,236, which issued Aug. 28, 1979, to Peter Andrews.

Finally, in addition to placement in switch and socket assemblies, rectifiers have also been provided in a removable form wherein a diode is provided in a disc-shaped housing for direct attachment to the base of an incandescent light bulb, and for easy removal therefrom for use with a different light bulb, as disclosed in U.S. Pat. No. 4,544,861, which issued Oct. 1, 1985, to Roy Kretchmar.

Although the known devices permit the benefits of rectification in various types of circuit arrangements, and although the rectification arrangements that include the positioning of rectifier elements in wall switches and in light sockets are usable to provide the benefits of rectification in conjunction with the use of three-way light bulbs, it is desirable to provide a rectifier housing that can be readily removed from an electric lighting circuit for reuse in another lighting circuit, and one that can also be used with such lighting devices as three-way light bulbs, decorative string lamps, christmas tree lamps, outdoor decorative lamps, night lights, and other incandescent lighting arrangements normally deriving power from a suitable electric outlet. It is therefore an object of the present invention to provide such a device.

SUMMARY OF THE INVENTION

Briefly stated, in accordance with one aspect of the present invention, there is provided a rectifier housing for connecting a lamp cord plug to a wall electrical outlet and the like. The housing includes a plug that extends from an enclosure formed from non-conductive material. The plug includes a plurality of contact blades that extend outwardly from a first face of the enclosure for engaging blade-receiving slots in a wall mounted electric outlet, and the like. A receptacle is received in and is carried by the enclosure, and the receptacle includes blade-receiving slots for receiving the blades of a lamp cord plug. The blade-receiving slots are provided in a face of the receptacle that defines a second face of the housing and is on a side of the housing that is opposite to the first face. A plurality of conductors are positioned within the enclosure for providing electrical contact between the contact blades of the plug and the contact blades that are inserted into respective ones of the blade-receiving slots in the receptacle. A rectifier means for rectifying electric energy carried by one of the conductor means is positioned within the enclosure and between one of the contact blades in the plug and one of the blade-receiving slots in the receptacle. The rectifier means is a part of one of the conductors, and thereby serves to rectify the current that passes from the wall outlet to a lamp cord plug that includes one or more lamps of either single or multiple filament structures.

DESCRIPTION OF THE PREFERRED EMBODIMENTS

Figure 3:
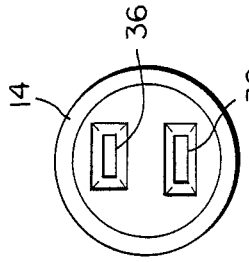
FIG. 3 is an end view of the rectifier housing illustrated in FIG. 1 looking toward the receptacle, and in the direction of arrow B thereof.
Figure 1:
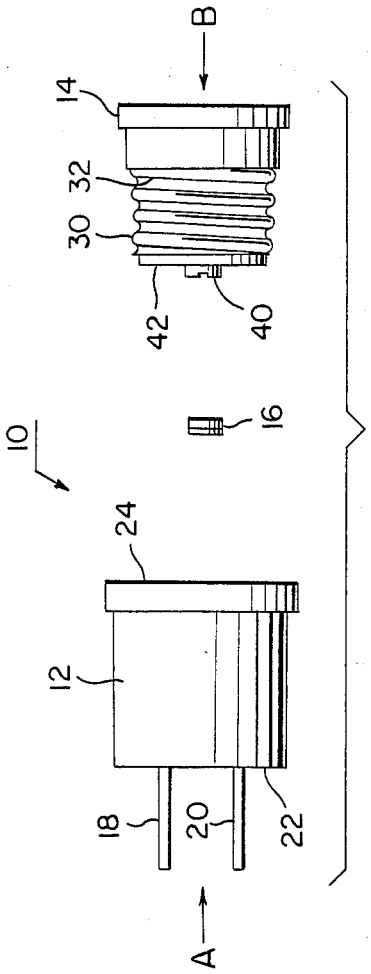
FIG. 1 is an exploded side view of one form of rectifier housing in accordance with the present invention.
Figure 2:
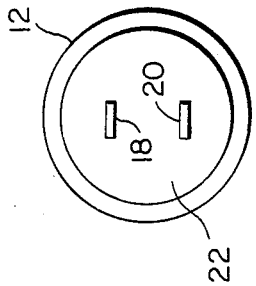
FIG. 2 is an end view of the plug portion of the rectifier housing illustrated in FIG. 1 and looking in the direction of arrow A thereof.

Referring now to the drawings, and particularly to FIGS. 1, 2, and 3 thereof, there is shown a rectifier housing 10 that includes a plug portion 12, a receptacle portion 14, and a diode 16. Plug portion 12, as shown, is of generally tubular shape, although the external configuration can be of any desired geometric cross section. A pair of contact blades 18, 20 extend from an end wall 22 provided in plug portion 12 to engage with contact-blade-receiving slots provided in a wall outlet (not shown) or on the receptacle portion of an extension cord, and the like. The end 24 of plug portion 12 opposite to the end from which the contact blades extend includes an opening 26 (see FIG. 4) and includes an internal thread 28 to receive an externally threaded receptacle portion 14 that carries external threads 30 that are engageable with internal thread 28 of plug portion 12. A conductive sleeve 32 is provided on receptacle portion 14 for engagement with a corresponding conductive sleeve 34 in plug portion 12, thereby permitting electrical connection between one of contact blades 18, 20 and one of blade-receiving slots 36, 38 provided in receptacle portion 14, as will hereinafter be explained. Receptacle portion 14 also includes a center terminal 40 at an end 42, which terminal is in electrical contact with the other of the slots 36, 38, and is adapted for engagement with a corresponding center terminal 44 (see FIG. 4) in plug portion 12. Diode 16 is adapted to be positioned between center terminals 40 and 44 of the respective portions of the assembly.

Plug portion 12 and receptacle portion 14 are preferably formed from a suitable dielectric material, such as plastics, for example, thermoplastic polyimide, polyphenylene sulfide, bakelite, or diallyl phthalate.

Referring again to FIG. 4, there is shown a cross-sectional view illustrating the interconnection between the several elements of one form of the rectifier housing in accordance with the present invention. As shown, the several elements have been assembled to their final assembly configuration, and contact blade 20 is in electrical contact with conductive sleeve 34 that includes thread 28 and is retained within plug portion 12. Contact blade 18 is electrically connected to center terminal 44, which can be secured to contact blade 18 by means of a rivet 46, or the like, or it can be soldered thereto. A pair of non-conductive spacers 48, 50, formed of paperboard, or the like, are positioned adjacent the transversely extending inner ends 52, 54 of contact blades 18, 20, respectively, and within the interior of plug portion 12 to permit only center terminal 50 to protrude beyond spacer 50 and into the interior of the plug portion.

Figure 4:
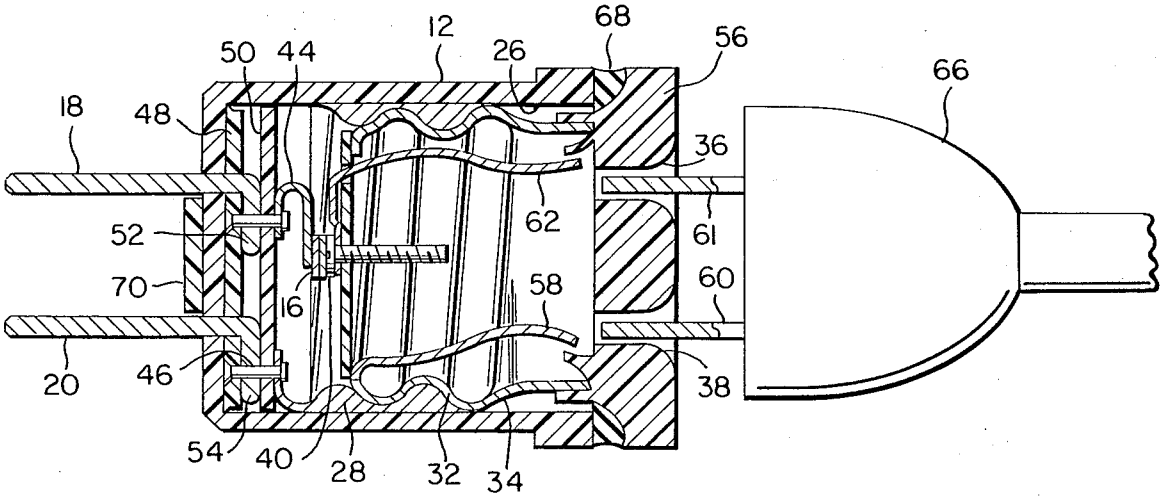
FIG. 4 is a longitudinal sectional view of an assembled rectifier housing as illustrated in FIG. 1.

Receptacle portion 14 as illustrated in FIG. 4 includes a disc-shaped end wall 56 that includes slots 36, 38. Extending from one face of end wall 56 is conductive sleeve 32, or the like, which is adapted to provide electrical contact with conductive sleeve 34 in plug section 12. A first spring contact 58 is electrically connected with conductive sleeve 32 and is positioned internally of receptacle portion 14 so that one surface thereof is positioned inwardly of and adjacent to slot 38 in such a way that when a contact blade 60 is inserted through slot 38 it will come into electrical contact with spring contact 58 to provide a conductive path therewith. Similarly, a second spring contact 62 is provided inwardly of and adjacent to slot 36 and has its innermost end 64 in electrical contact with center terminal 40 of receptacle portion 14. Center terminal 40 can be defined by a metal screw that contacts second spring contact 62 and is threadedly received in the central portion of the cylindrical end of receptacle portion 14. Diode 16 is soldered or otherwise conductively secured to the end of the screw, although if desired it can alternatively be soldered to center terminal 50 of plug portion 12. In any event, diode 16 is preferably positioned between and in electrical contact with each of center contact 50 of plug portion 12 and center contact 40 of receptacle portion 14.

A line cord plug 66 that extends from the lamp or series of lamps intended to be connected through rectifier housing 10 can be inserted in slots 36, 38 in receptacle portion 14 to engage contacts 62, 58, respectively, and thereby provide electrical contact between contact blades 60, 61 of line cord plug 66 and contact blades 20, 18, respectively, of plug portion 12. Additionally, as also shown in FIG. 4, preferably a sealing material 68 is forced between the adjacent outer edges of plug portion 12 and the receptacle portion 14, after assembly thereof, to provide a tight seal therebetween. Examples of suitable sealing materials include RTV silicone (manufactured by General Electric Company), and the like.

As also seen in FIG. 4, end 22 of rectifier housing 10 preferably includes securing means, such as a double-faced adhesive tape 70, or the like, for securing housing 10 to a wall outlet or other receptacle with which it is connected. A suitable double-sided tape can be, for example, "VHB" double coated neoprene foam tape, No. 4965, manufactured by 3M Company.

Figure 5:
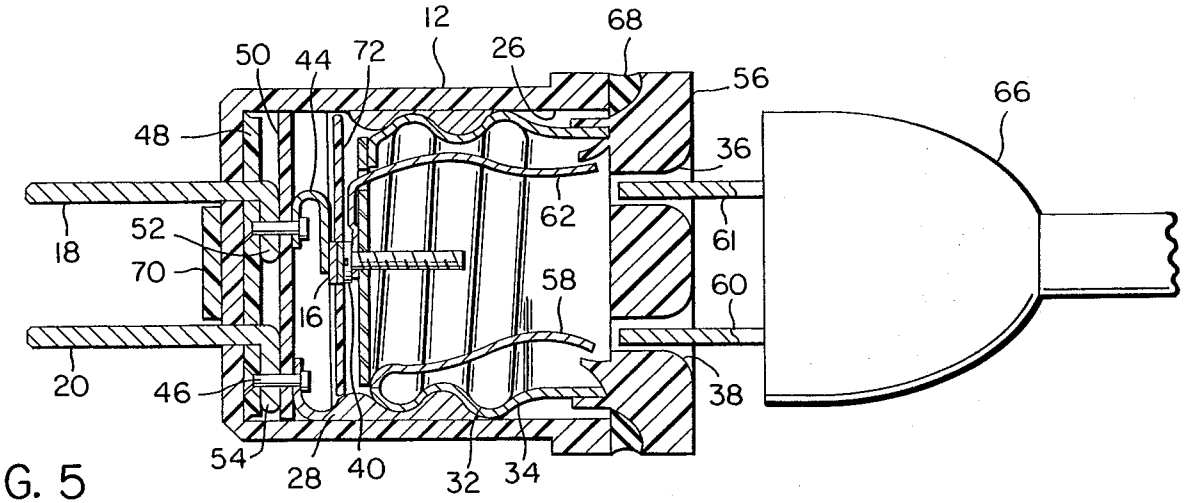
FIG. 5 is a longitudinal cross-sectional view similar to that of FIG. 4 and showing a disc-shaped rectifier holder positioned within a rectifier housing in accordance with the present invention.

In addition to providing the diode 16 in a soldered connection to one or the other of center terminals 40, 44 within housing 10, the diode can also be removably positioned within the housing as shown in FIG. 5 by assembling the diode in a disc-shaped holder 72, or retainer, that is formed from a dielectric material, and that has a diameter of a size sufficient to permit the disc to be positioned within the housing so that the diode is opposite to and in electrical contact with each of the center terminal of plug portion 12 and receptacle portion 14.

Figure 7:
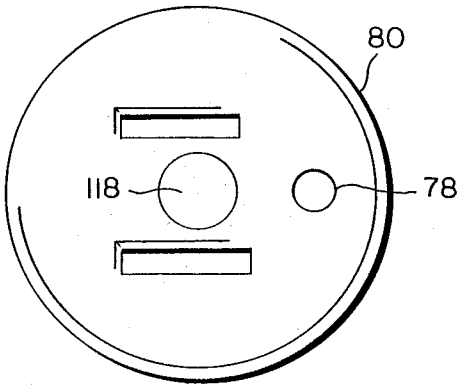
FIG. 7 is an end view of the rectifier housing of FIG. 6 looking at the end in which the blade-receiving slots are formed.
Figure 6:
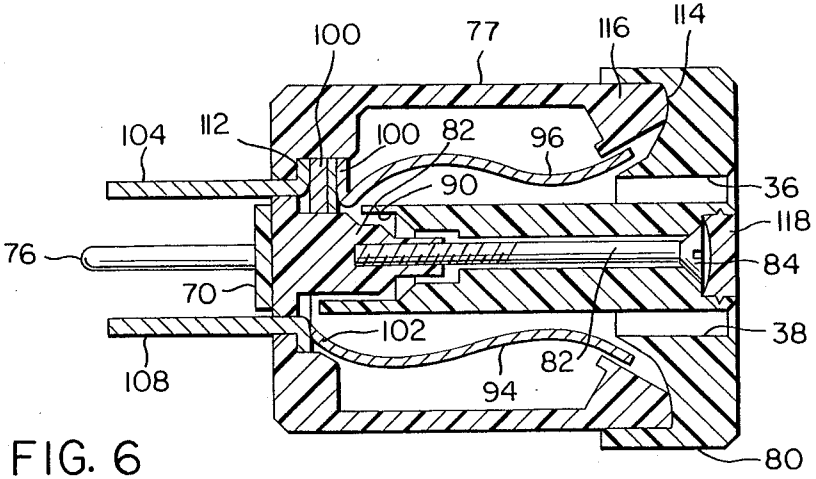
FIG. 6 is a longitudinal cross-sectional view of another embodiment of a rectifier housing in accordance with the present invention.

An alternative embodiment for a rectifier housing 74 in accordance with the present invention is illustrated in FIGS. 6 and 7. In that particular embodiment suitable grounding contacts are provided in the form of a grounding blade 76 in the plug portion 77 and a grounding blade-receiving opening 78 in the receptacle portion 80. Additionally, the plug portion 77 and the receptacle portion 80 can be sealed together with a suitable adhesive or sealant, such as, for example, RTV silicone, manufactured by General Electric Company, and are not in threaded engagement as in the embodiment illustrated in FIGS. 4 and 5. Plug portion 77 includes a central boss 82 which is adapted to threadedly receive a retaining screw 84 that passes through a substantially centrally positioned aperture 86 in receptacle portion 80, the latter also including a central cylindrical portion 88 that includes an inner end opening 90 adapted to receive and engage with boss 82. Center portion 88 of receptacle portion 80 has outer dimensions that are smaller than the inner dimensions of plug portion 77 to permit the positioning therebetween of respective spring contacts 92, 94 that have one end 96, 98, respectively, positioned adjacent the blade-receiving slots in the receptacle, and the opposite ends 100, 102, respectively, in contact with contact blades 104, 106. Spring contact 92 is shorter than spring contact 94 and includes an end terminal 108 adapted to abut and electrically contact diode 110, which is received in recess 112 formed in plug portion 77 adjacent contact blade 104 so that there is direct electrical contact between contact blade 104 and spring contact 92 through diode 110. A suitable additional spring contact (not shown) is provided so that electrical connection can be achieved between grounding blade 76 of plug 77 and the grounding blade of a plug that is intended to be inserted into and engaged with housing receptacle portion 80. Additionally, receptacle portion 80 includes a recessed engaging groove 114 that is adapted to engage the annular end 116 of plug portion 77 and can be sealed thereto by suitable adhesives. Additionally, the head of retaining screw 84 can be recessed into receptacle portion 80 and a suitable screw cover plug 118 can be friction fitted to a recession receptacle portion 80 to conceal the retainer screw.

In operation, the embodiments illustrated in FIGS. 1 through 7 are adapted to receive a single line cord plug and to permit the connection of that plug with a wall outlet, with the outlet end of an extension cord, or the like. The positioning of the rectifier within the housing provides half-wave rectification of the electric current that passes through the housing, and thereby reduces the current that flows to either a single filament bulb, or three-way bulb, or a string of a plurality of lamps or bulbs. As will be appreciated by those skilled in the art, the provision of the removable rectifier housing of the present invention does not permanently affect the power available at the wall outlet, or the like, as would occur if the rectifier were placed within a wall switch, within the wall outlet, or otherwise at a point between the wall outlet and the source of power. Thus a particular outlet can be used to provide full power by removing the rectifier housing if it is later decided to connect a different appliance to that particular wall outlet. Further, the rectifier housing of the present invention is readily usable with an extension cord that is connected with a wall outlet. Thus it can be appreciated that the rectifier housing in accordance with the present invention is very advantageous and provides wide flexibility of use with particular outlets and extension cords, depending upon the desires of the user.

Figure 10:
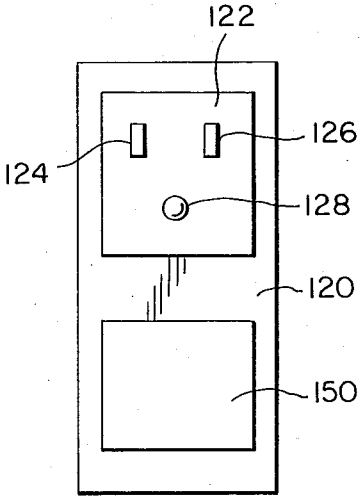
FIG. 10 is a rear view of the rectifier housing of FIG. 8.
Figure 8:
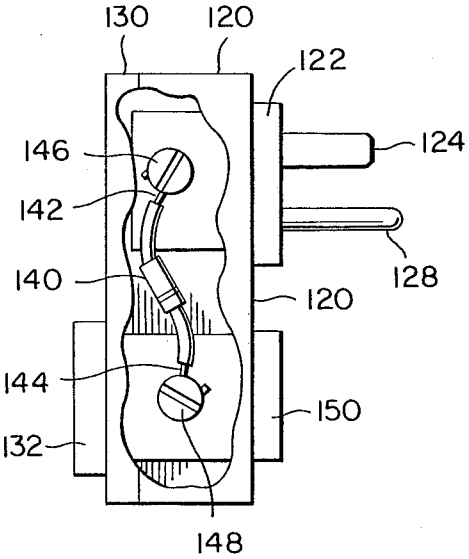
FIG. 8 is a side elevational view, partially broken away, showing another form of rectifier housing in accordance with the present invention.
Figure 9:
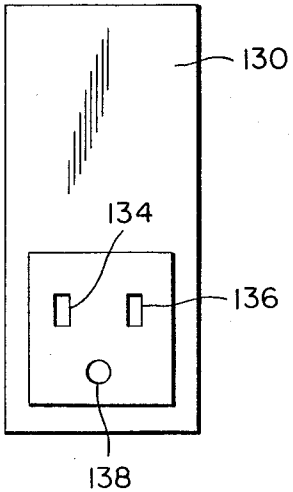
FIG. 9 is a front view of the rectifier housing of FIG. 8.

In addition to providing a rectifier housing in accordance with the present invention and in which a single, in-line receptacle is provided, a housing wherein the plug portion and the receptacle portion are laterally offset from each other can also be provided, as illustrated in FIGS. 8, 9, and 10. As therein shown a housing 120 is provided that serves to define a hollow enclosure to receive a plug portion 122 that includes outwardly extending contact blades 124, 126, 128 that are engageable with a corresponding wall outlet, or the like, housing 120 being provided with an outwardly facing cover 130. Spaced laterally from the direction in which the blade contacts 124, 126, and 128 extend is a receptacle portion 132, in which blade-receiving slots 134, 136, and 138 are oriented to extend in a direction substantially parallel to the contact blades of plug portion 122. Each of receptacle portion 132 and plug portion 122 is rigidly secured to and contained substantially within housing 120.

As seen in FIG. 8, a diode is provided within housing 120 and is connected by means of respective conductors 142, 144 to a terminal 146 provided on plug portion 122 and to a terminal portion 148 provided on receptacle portion 132. Terminal 146 in plug portion 122 is in electrical contact with one of contact blades 124 or 126, and terminal 148 in receptacle portion 132 is in electrical contact with a contact spring (not shown), or the like, provided in receptacle portion 132 so that when a plug is inserted in the slots of the receptacle portion, one blade of the inserted plug is in electrical contact with one of the contact blades of the plug portion through diode 140 in order to obtain the benefits of rectification provided by the diode. As illustrated in FIG. 8, terminals 146 and 148 are screw-type terminals, although other terminal structures can be provided, as will be appreciated by those skilled in the art. Further, a suitable means for preventing unnecessary movement of the housing, such as a tape 150 of the double coated foam-type can be provided on the portion of the housing that is opposite to the slots in the receptacle portion to secure the housing to a wall outlet. Further, the foam can be of a thickness such that when plug portion 122 of the housing is engaged with the upper portion of a double wall outlet, plug portion 122 and the portion of the housing opposite to receptacle portion 132 are substantially equally spaced from the wall outlet.

Figure 11:
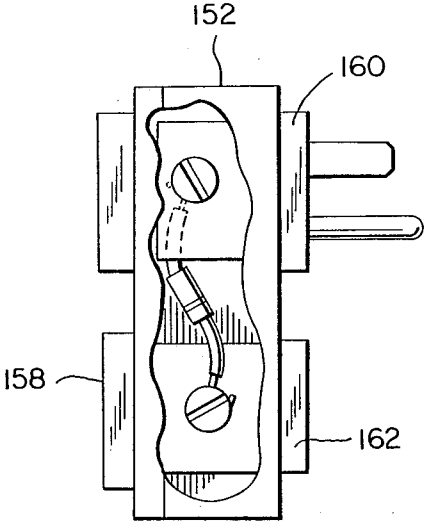
FIG. 11 is a side elevational view of a still further embodiment of a rectifier housing in accordance with the present invention.
Figure 12:
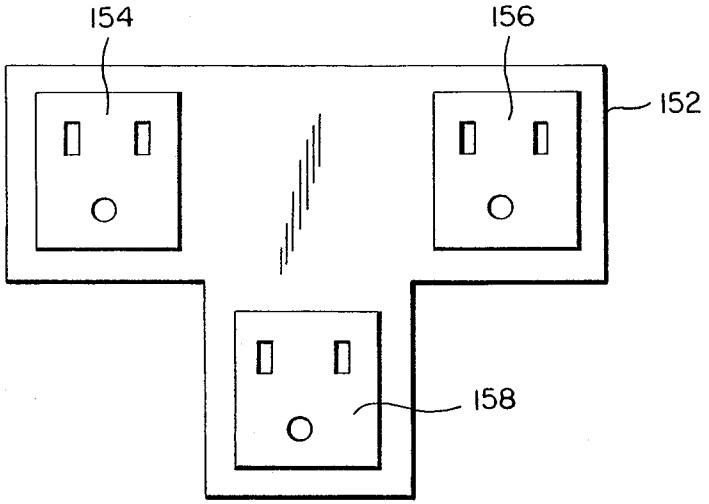
FIG. 12 is a front view of the rectifier housing shown in FIG. 11.
Figure 13:
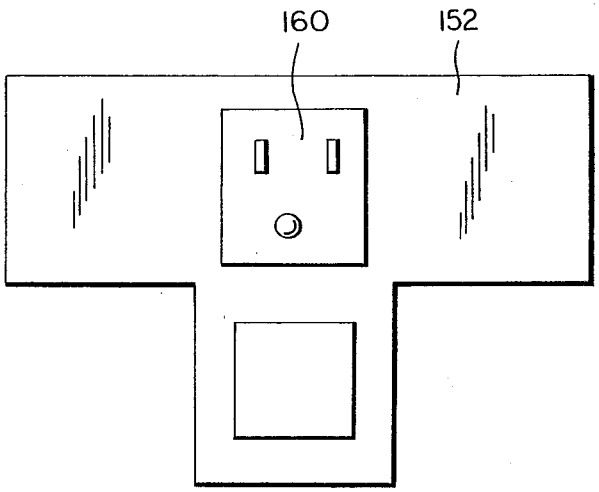
FIG. 13 is a rear view of the rectifier housing shown in FIG. 11.

An additional embodiment of the present invention is illustrated in FIGS. 11 through 13, in which a housing 152 similar to that shown in FIGS. 8 through 10 is provided, except that a plurality of receptacles 154, 156, and 158 are provided in the housing, and with each of the receptacles having blade-receiving slots in electrical contact with the contact blades of plug portion 160. Housing 152, as shown, is of substantially T-shaped and the plug portion that engages with the wall outlet is preferably centrally positioned for engagement with the upper receptacle of a double wall outlet, and is also provided with a double-side adhesive tape 162 that can include a foam spacer, as in the embodiment illustrated in FIGS. 8 through 10.

In the embodiment illustrated in FIGS. 11 through 13, the center receptacle 158 is connected with plug portion 160 through diode 164 in a manner similar to the embodiment illustrated in FIGS. 8 through 10. Thus the center receptacle would provide rectified power whereas upper receptacles 154 and 156 would not. However, by connecting additional diodes from plug portion 160 to respective terminals of upper receptacles 154 and 156, either one, two, or all of the receptacles can provide rectified power, if desired. Further, although disclosed in the context of its use in connection with a wall outlet, either of the embodiments of FIGS. 8 through 10 or of FIGS. 11 through 13 can also be used with an extension cord, or the like, to permit the connection of one or more lamps or series of lamps to one or more receptacles that are either provided with rectified current or with unrectified current, as desired.

Although particular embodiments of the present invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. A rectifier housing for connecting a lamp cord plug to a source of electrical energy, said housing comprising:

(a) a plug formed from non-conductive material and defining an enclosure, said plug having a plurality of electrically conductive contact blades extending outwardly from a first face of said enclosure for engaging blade-receiving slots in an electric outlet;

(b) a receptacle received in and carried by said enclosure and having blade-receiving slots for receiving blades of said lamp cord plug, said blade-receiving slots provided in a face of said receptacle that defines a second face of said housing on a side of said housing opposite to said first face;

(c) a plurality of conductor means positioned within said enclosure for providing electrical contact between said contact blades in said plug and contact blades positioned into respective ones of said blade-receiving slots in said receptacle;

(d) rectifier means for rectifying electric energy carried by one of said conductor means, said rectifier means positioned within said enclosure and between one of said contact blades in said plug and one of said blade-receiving slots in said receptacle, said rectifier means being a part of said one of said conductor means for providing rectified electric energy to said lamp cord plug; and wherein said enclosure includes an internally threaded casing and said receptacle is provided in an externally threaded adapter for threaded engagement with said casing.

2. A rectifier housing for connecting a lamp cord plug to a source of electrical energy, said housing comprising:

(a) a plug formed from non-conductive material and defining an enclosure, said plug having a plurality of electrically conductive contact blades extending outwardly from a first face of said enclosure for engaging blade-receiving slots in an electric outlet;

(b) a receptacle received in and carried by said enclosure and having blade-receiving slots for receiving blades of said lamp cord plug, said blade-receiving slots provided in a face of said receptacle that defines a second face of said housing on a side of said housing opposite to said first face;

(c) a plurality of conductor means positioned within said enclosure for providing electrical contact between said contact blades in said plug and contact blades positioned into respective ones of said blade-receiving slots in said receptacle;

(d) rectifier means for rectifying electric energy carried by one of said conductor means, said rectifier means positioned within said enclosure and between one of said contact blades in said plug and one of said blade-receiving slots in said receptacle, said rectifier means being a part of said one of said conductor means for providing rectified electric energy to said lamp cord plug; and wherein said receptacle includes a center terminal in electrical contact with one of a pair of contact members positioned within said blade-receiving slots, and said rectifier means includes a substantially disc-shaped rectifier housing of non-conductive material adapted to be received transversely in said enclosure, and a rectifier element carried by said rectifier housing and contacting said center terminal and in electrical contact with one of said contact blades.

3. A rectifier housing as claimed in claim 2, including sealing means provided between said plug and said receptacle at an external junction therebetween.

4. A rectifier housing as claimed in claim 2, wherein said plug includes securing means carried by said plug adjacent said contact blades for securing said housing to said outlet.

5. A rectifier housing as claimed in claim 4, wherein said securing means is a double-faced adhesive tape.

* * * * *